US005810020A

United States Patent [19]

Northway et al.

[11] Patent Number: 5,810,020

[45] Date of Patent: Sep. 22, 1998

[54] PROCESS FOR REMOVING NITROGEN-CONTAINING ANIONS AND TOBACCO-SPECIFIC NITROSAMINES FROM TOBACCO PRODUCTS

[75] Inventors: Steven Northway; Robert Salter, both of Corvallis, Oreg.

[73] Assignee: Osmotek, Inc., Corvallis, Oreg.

[21] Appl. No.: 117,434

[22] Filed: Sep. 7, 1993

[51] Int. Cl.[6] ..... A24B 15/24; A24B 15/26

[52] U.S. Cl. ..... 131/297; 131/334; 131/341; 131/344; 131/298; 131/347; 423/157; 423/194; 423/208

[58] Field of Search ..... 131/297, 334, 131/341, 344, 298; 423/157, 194, 208

[56] References Cited

U.S. PATENT DOCUMENTS

| | | | |
|---|---|---|---|
| 3,616,801 | 11/1971 | Hind . | |
| 3,847,164 | 11/1974 | Mattina et al. . | |
| 4,131,117 | 12/1978 | Kite et al. . | |
| 4,131,118 | 12/1978 | Gellatly et al. . | |
| 4,364,401 | 12/1982 | Keritsis | 131/297 |
| 4,566,469 | 1/1986 | Semp et al. . | |
| 5,065,775 | 11/1991 | Fagg . | |

FOREIGN PATENT DOCUMENTS

| | | |
|---|---|---|
| A0070112 | 1/1983 | European Pat. Off. . |
| A0076642 | 4/1983 | European Pat. Off. . |

OTHER PUBLICATIONS

Takeda et al., Chem. Lett. 1377, 1978.
Hecht et al., N–Nitrosamines ACS Symposium Series 101:125, 1979.
Hoffmann et al., N–Nitroso Compounds ACS Symposium Series 174:247, 1981.
Singer and Cole, J. Org. Chem. 46:3461, 1981.
Archer et al. Environmental N–Nitroso Compounds Anaylsis and Formation Int. Agency for Research on Cancer 14:141, 1976.
Hildrum et al., Ag. Food Chem. 25:252, 1977. [Hildrum et al. I].
Hildrum and Scanlan, Ag. Food Chem. 25:255, 1977.
Hildrum et al., Ag. Food Chem. 23:34, 1975.
Hallett et al., J.C.S. Perkin II, 1372, 1980.
Williams, J.C.S. Perkin II, 655, 1975.
Thompson et al., J.C.S. Perkin II, 1932, 1977.
Kahn et al., Bull. Chem. Soc. Jpn. 59:1285, 1986.
Dulyea et al., J. Mem. Sci. 34:87, 1987.
Strzelbicki et al., Anal. Chem. 53:1894, 1981.
Charewicz et al., Anal. Chem. 54:2094, 1982.
Yang et al., Chem. Abstracts 96:206305u, 1982.
Manor et al., Chem. Abstracts 96:87954t, 1982.

*Primary Examiner*—James J. Seidleck
*Assistant Examiner*—Duc Truong
*Attorney, Agent, or Firm*—Jeffrey B. Oster

[57] ABSTRACT

There is disclosed a process for denitrifying tobacco materials and removing barium from tobacco materials, comprising mixing an aqueous-immiscible organic solvent containing a crown ether with an aqueous solution containing soluble components from tobacco materials, agitating this mixture, and separating the organic phase containing a crown ether-cation-nitrate (or nitrite) complex from the aqueous phase containing the denitrified tobacco materials, wherein the cation consists essentially of barium and potassium. There is further disclosed a process for eliminating tobacco-specific nitrosamines (TSNAs) from cured, denitrified tobacco material, comprising contacting the denitrified tobacco material with a trapping sink, wherein the trapping sink comprises a select transition metal complex which is readily nitrosated to form a nitrosyl complex with little kinetic or thermodynamic hindrance.

21 Claims, 4 Drawing Sheets

PROCESS FOR REMOVING NITROGEN-CONTAINING ANIONS AND TOBACCO-SPECIFIC NITROSAMINES FROM TOBACCO PRODUCTS

TECHNICAL FIELD OF THE INVENTION

The present invention relates to a two-step process to first remove nitrogen-containing anions from tobacco products by a solvent and crown ether or crown ether-like solute extraction process to denitrify tobacco materials. The first step of the inventive process comprises contacting a solution of a crown ether or crown ether-like solute in an aqueous-immiscible organic solvent and an aqueous solution containing the tobacco material, and separating the nitrate-loaded or nitrite-loaded organic phase containing the crown ether-cation-nitrate (or nitrite) complex, wherein the aqueous phase wholly contains the denitrified tobacco material. The first step of the inventive process effectively removes most nitrate and nitrite anions and barium cations from a tobacco product. The second step of the inventive process comprises eliminating tobacco-specific nitrosamines (TSNAs) from the denitrified tobacco material by contacting the tobacco material with a trapping sink, wherein the trapping sink comprises a select transition metal complex which is readily nitrosated to form a nitrosyl complex with little kinetic or thermodynamic hindrance.

BACKGROUND OF THE INVENTION

Tobacco contains a number of nitrogen-containing substances which, during burning of the tobacco, yield various undesirable components in the smoke, such as nitric oxide, nitrogen dioxide, methyl nitrate and TSNAs. It is generally recognized that tobacco-based smoking products having reduced amounts of nitrogen, particularly those combusting to nitrogen oxides (NOX) in the tobacco are desirable. Nitrate or nitrite salts, such as potassium, calcium and magnesium nitrates, are a major class of nitrogenous substances which are precursors for nitrogen oxides and condensed phase nitrosating agents (HONO and $NO_2^-$). Nitrate salts are normally found in abundance in burley tobacco stems and strip, and to a lesser extent, in flue-cured tobacco stems. Attempts have been made to reduce or remove nitrate from these tobaccos to reduce the undesirable nitrogen components in smoke.

For example, U.S. Pat. Nos. 4,131,118 and 4,131,117 describe a crude nitrogen extraction method whereby potassium nitrate is crystallized in tobacco extracts by refrigeration and removed from the extract by centrifugation or filtering. This process removes many other salts as well as nitrogen salts. Moreover, this procedure does not control for the amount of nitrate removed form the tobacco material.

U.S. Pat. No. 3,847,164 refers to a method to remove "ionic material" from tobacco extract by contacting the extract with an ion retardation resin to separate ionic material from nonionic material. This process essentially creates a tobacco extract, passes the extract through an ion exchange column, and returns the column flow-through back to the extracted tobacco fibrous material. This method provides no control over the amount of nitrate removed from the tobacco material.

Other attempts to denitrify tobacco extracts have included electrodialysis (described in U.S. Pat. No. 4,364,401) and a dissimilatory denitrification process using microorganisms (described in U.S. Pat. No. 4,566,469 and in European Patent Applications EP-A70112 and EP-A76642). None of the earlier processes can effect denitrification of tobacco directly or in a timely, efficient and cost-effective manner without substantially altering the quality of the denitrified tobacco product. Further, none of these processes provide much control over the amount of nitrate removed from tobacco material. Therefore, there is a need in the art to develop an improved process to denitrify tobacco directly without first precipitating the salts from tobacco material.

Additional undesirable elements in tobacco products include concentrations of barium. Barium is found in both stems and leaves of tobacco plants. Therefore, there is a need in the art to selectively remove barium from tobacco products and to remove barium from the nitrogen-containing by-product so that it will not be a contaminant of fertilizer made from by-products of tobacco processing.

A group of TSNAs have been identified in cured tobacco. These nitrosamines are may be derived from tobacco alkaloids, of which nicotine is the most prevalent. Nicotine is found in concentration of around 1% to 2% in tobacco products. It has been postulated, according to one group of researchers, that nicotine is nitrosated to form N'-nitrosonornicotine (NNN), or possibly 4-(N-methyl-N-nitrosamino)-1-(3-pyridyl)-1-butanone (NNK) or 4-(N-methyl-N-nitrosamino)-4-(3-pyridyl) butanol (NNA) (Hoffman et al., "Formation, Occurrence, and Carcinogenicity of N-Nitrosamines in Tobacco Products" in O'Neill et al., *N-Nitroso Compounds: Occurrence, Biological Effects and Relevance To Human Cancer,* World Health Organization, 1984.) It is possible that NNN may have been detected in both tobacco smoke and in unburned tobacco. Hecht et al. ("Tobacco specific N-Nitrosamines Occurrence, Carcinogenicity, and Metabolism" *Amer. Chem. Soc.,* 1979) postulated that NNN levels in cigarette smoke may range from 140–240 ng/cigarette in a typical American 85 mm non-filter cigarette. Hecht et al. also postulated that NNN is in unburned tobacco at levels in the range of 0.3–9.0 ppm in cigarette tobacco, 3.0–45.3 ppm in cigar tobacco, 3.5–90.6 ppm in chewing tobacco and 12.1–29.1 ppm in snuff.

When Burley tobacco was analyzed for NNN during various stages of growth and curing, no NNN was detected prior to harvest or in freshly harvested Burley tobacco. After air curing about 0.5–1.1 ppm of NNN was found, presumably formed by reaction of $NO_2^-$ and nicotine (Id.). Further, tracer isotope analysis showed that about 50% of NNN in cigarette smoke originated by evaporative transfer of pre-existing NNN from tobacco while the remainder was formed from nicotine and $NO_3^-$ pyrolysis products during smoking (Id). Accordingly, it appears that quantities of TSNAs in smoke are dependent on the concentrations of nitrate, nitrite, alkaloids (e.g., nicotine) and NNN, NNK and NNA in the tobacco itself Therefore, there is a need in the art to further eliminate TSNAs from tobacco products after the nitrosating agents have been removed.

Crown ethers are large ring molecules containing heteroatoms (e.g., oxygen) with lone pair electrons. Terminology to describe crown ethers is often described as #C# wherein the first number is the number of atoms in the ring and the second number is the number of hetero elements in the ring. Crown ethers essentially chelate oxy-complexing cations and assume a positive charge enabling them to drag along an anion. One of the results of this ion pair formation is an ability to transport "ionic" materials, such as KOH, into organic solvents such as benzene. The ability to chelate a cation and drag along an anion is called "counterion coextraction."

There have been many studies examining phase transfer for cations and inorganic anions using crown ethers.

Generally, nitrates were not recognized as useful counterions for transferable cations in crown ethers in a variety of carrier solvents. For example, Gerow et al., *Separation Science Technology* 16:519, 1981 concludes that "Probably because of its lack of hydrophobic character, however, the $NO_3^-$ anion does not enhance metal extraction into the organic phase. The $Cl^-$ anion is equally ineffective, while the $NO_2^-$ anion is slightly more effective than $NO_3^-$ or $Cl^-$." Marcus et al., *J Phys. Chem.* 82:1246, 1978 found that crown ether extraction is most efficient with large and highly polarizable anions such as picrate.

Highly selective removal of TSNAs and possibly nitrosating precursors $NO_3^-$ and $NO_2^-$ would be desirable because it would be beneficial to the tobacco user's health while retaining the marketable addictive and organoleptic properties of the tobacco products. It is possible that under certain conditions and in the presence of the high nitrate contents in certain types of tobacco, partial pyrolytic oxidative nitrosation of nicotine to highly carcinogenic 4-(methylnitrosamino)-1-(3-pyridyl)-1-butanone (NNK) can occur during tobacco smoking. Other reports suggest pyrosyntheticnitrosation of tobacco specific alkaloids to other TSNAs, possibly by mechanisms of pyrolysis of $NO_3^-$ and $NO_2^-$ to the nitrosating agents $N_2O_3$ and $NO_2^-$. Although these data in support of pyrosynthetic nitrosation of tobacco-specific alkaloids by $NO_3^-$ and $NO_2^-$ pyrolysis products is still skeletal and inconclusive, data supporting solution-phase nitrosation of curing or stored smoking or smokeless tobacco products by $NO_3^-$-derived nitrosating species to produce preformed TSNAs is more complete and supportive of $NO_3^-$ assisted genesis of observed TSNAs.

SUMMARY OF THE INVENTION

The present invention is a process for controllably denitrifying tobacco materials, such as tobacco extracts using crown ether-based extraction of barium, nitrates, nitrites and other nitrosating agents using a phase-mixing and/or a membrane-based extraction process, and then eliminating TSNAs from the denitrosated tobacco material. The inventive phase-mixing process for removing nitrates, nitrites and other nitrosating agents, comprises contacting an aqueous-immiscible organic solvent and a crown ether with an aqueous solution containing the tobacco material, forming a crown ether-cation-nitrate (or nitrite) complex having a high solubility in a selected carrier solvent, and phase separating the organic phase containing the solvent and crown ether-cation-nitrate (or nitrite) complex, from the aqueous phase containing the denitrified tobacco material. The process for eliminating TSNAs from the denitrified tobacco material comprises contacting the denitrified tobacco material with a trapping sink to denitrosate the tobacco material, wherein the trapping sink comprises a select transition metal complex which is readily nitrosated to form a nitrosyl complex with little kinetic or thermodynamic hindrance and a free radical interceptor. Preferably, a catalyst is added to the trapping sink, wherein the catalyst is a nucleophile, such as $SCN^-$. Preferably, the cation of the crown ether-cation-nitrate (or nitrite) complex is barium and potassium. Preferably, the process of contacting, forming a crown ether-cation-nitrate (or nitrite) complex, and phase separating are repeated from one to twelve times in a series of extractor tanks. Each "stage" of contacting, forming a crown ether-cation-nitrate (or nitrite) complex and phase separating removes from about 5% to about 80% of the total nitrates and nitrites remaining in the tobacco material. Denitrified tobacco extract is returned to combine with insoluble tobacco residues or to blend with low-nitrate cured tobaccos or is further processed to eliminate TSNAs as described herein. Therefore, the denitrification aspect of the present inventive process allows for controlled removal of selected amount of nitrogen depending upon (1) the concentration of crown ether, (2) the ratio of crown ether/solvent to aqueous tobacco material, (3) the tobacco solids concentration of the aqueous extract, (4) the number of stages of the process, (5) the crown ether carrier solvent; and (6) the area of aqueous/organic interface, which is a function of the contacting or mixing rate in the solvent extraction process or the membrane surface area in a membrane-based process.

A membrane-based solvent extraction process for nitrates, nitrites and barium comprises providing an aqueous feed stream comprising a tobacco extract to a first side of a membrane wherein the membrane is wetted by water or organic carrier solvent, providing an organic stream to a second side of the nonporous hydrophillic membrane in a countercurrent direction, wherein the organic phase comprises a selected carrier organic solvent and a crown ether, forming a crown ether-cation-nitrate (or nitrite) complex in the selected carrier organic solvent, and separating the crown ether-cation-nitrate (or nitrite) complex from the selected carrier organic solvent to regenerate the crown ether and provide separate barium and nitrate material. Preferably, the cation of the crown ether-cation-nitrate (or nitrite) complex is barium and potassium. The process of separating barium from the crown ether-cation-nitrate (or nitrite) complex comprises contacting the organic phase solution with a bidentate ligand in a slightly basic solution (pH from about 8 to about 12), and removing the barium ion while leaving potassium ion to remain chelated in the crown ether-cation-nitrate (or nitrite) complex. An example of a bidentate ligand is $K_2EDTA$ having two amino groups and a pK of about 7–8. Therefore, the bidentate ligand is not in contact with the tobacco material.

The present invention is further designed to remove nitrate and nitrite anions from tobacco materials, either as early in the curing process as possible to prevent formation of TSNAs by removing an essential component of their formation (i.e., nitrate or nitrite) in tobacco, or to remove the pyrolytic nitrosating agent $NO_3^-$ from fully cured tobacco for later elimination of TSNAs. The present invention further provides a method to remove barium from tobacco products without removing other cations that may effect tobacco flavor. The present invention further provides a commercial scale nitrate and nitrite anion extraction device for phase-mixing extraction of nitrate, nitrite and barium from tobacco products, comprising a series of phase contacting tanks with continuous flowing of immiscible light streams and heavy streams to extract anionic nitrate and nitrite from tobacco materials into a newly formed crown ether-cation-anion complex in the organic carrier solvent, which is stripped to regenerate crown ether, thereby removing nitrate and nitrite to a byproduct salt and producing a partially denitrified aqueous tobacco material to move to the next stage of extraction. The crown ether is recycled by contacting the crown ether metal cation-anion complex in the organic phase with a dilute stripping solution of a strong aqueous acid (e.g., sulfuric acid or hydrochloric acid) or water to strip anions and cations from the crown ether. The anions and cations migrate to the aqueous phase, while the crown ether remains in the organic carrier phase for recycling back to an extraction step. Furthermore, such batch processing can be scaled to commercial continuous extractor schemes, including, but not limited to concurrent stream extractors, turbine mixer-centrifuge separators and pulsed columns (e.g., Karr extractors).

The present invention further comprises a process for selectively removing nitrate and nitrite from process aqueous streams, comprising mixing an aqueous-immiscible organic solvent containing a crown ether having selectivity for potassium ions or another cation which will bind to the crown ether and an aqueous solution containing nitrate or nitrite ions, agitating the organic solvent/aqueous mixture to form a crown ether-cation-nitrate (or nitrite) complex in the organic phase, and separating the organic phase containing the crown ether-cation-nitrate (or nitrite) complex from the aqueous phase.

DETAILED DESCRIPTION OF THE INVENTION

Figure 1:
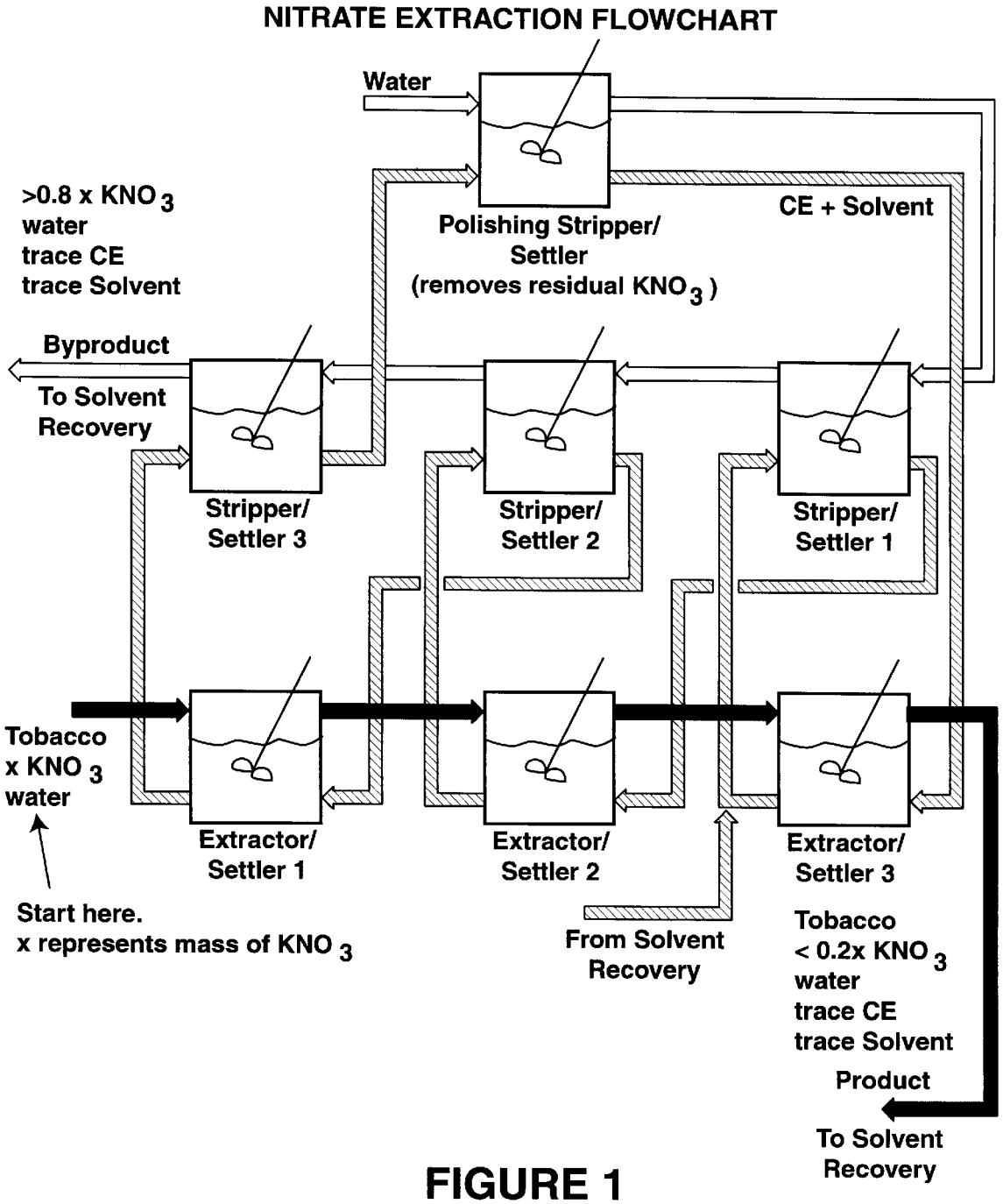
FIG. 1 illustrates a schematic diagram of a continuous flow extraction process having three stages of extraction of tobacco materials.

The advantage of the present invention over previous attempts to remove nitrate from tobacco materials is that the control of several variables of the separation process provides total control over the rate and amount of nitrate to be removed from tobacco material. The variables include: (1) concentration and identity of crown ether in the solvent, (2) volumetric ratio of solvent phase to aqueous phase, (3) the concentration of the aqueous tobacco extract in terms of the solids concentration dissolved in the extract, (4) the number of stages of separation that a particular tobacco material will undergo or the length of the membrane system, (5) selectivity for a given cation-anion pair (e.g., $K^+NO_3^-$ or $Ba^+NO_3^-$) which can be altered at will by choice of the carrier solvent and crown ether combination; and (6) the area of aqueous/organic interface, which is a function of the contacting or mixing rate in the solvent extraction process or the membrane surface area in a membrane-based process.

The present invention provides a controlled solvent extraction process to selectively and controllably remove some or practically all nitrate and nitrite from tobacco materials utilizing selected crown ethers in selected solvents. The tobacco materials are preferably those tobacco plant parts or materials derived from those tobacco plant parts that have the highest concentration of nitrate. The tobacco material can be green leaves and stems or cured tobacco parts. The tobacco parts are tobacco leaves, stems or dust, and which have been ground or pulverized. Tobacco solid materials suitable for use may be in various forms such as leaf, shredded filler, rolled, crushed or shredded stems or tobacco fines. The inventive process is particularly suitable for tobacco solid materials, such as Burley stem tobacco and other tobacco waste products, which have a high nitrate concentration when compared with other tobacco sources such as bright tobacco. As used herein, references to tobacco materials are intended to mean tobacco components such as slurries and aqueous extracts of tobacco having a dissolved solids content of from about 1% to about 30% by weight.

The solid tobacco material is formed into an extract, for example, an aqueous solution, to separate the aqueous soluble components, including potassium and nitrate salts, from the solid tobacco material. The extracting solution is preferably water, and most preferably distilled or deionized water. A method for making an aqueous tobacco extract is described in U.S. Pat. No. 5,065,775, the disclosure of which is incorporated by reference herein. Solid tobacco material is contacted with the aqueous solution at a percentage from about 5% to about 25% (w/w) solids at a temperature of about 20° C. to about 100° C., preferably 60° C. to 95° C. The extraction procedure is incubated for a few seconds up to five minutes. In order to maximize the extraction of nitrate from the solid tobacco material, the wetted solid tobacco material is pressed or centrifuged after completion of the extraction incubation whereby excess water and residual nitrate that may be present on the tobacco surface and in suspension are removed into the tobacco extract. This will eliminate any need for drying the solid tobacco material to remove excess moisture.

The resulting tobacco extract is separated from insoluble solid tobacco fibrous residue. The tobacco extract may be separated by conventional solid-liquid separation techniques, such as centrifugation or filtration.

Greater percentages of nitrate can be removed with each stage of the inventive extraction process when the tobacco extract is made with a higher concentration of tobacco solid materials. For example, when a 15.6% solids solution from an aqueous extraction of Burley tobacco stems was extracted by the inventive process at 10° C. for 15 minutes, approximately 80% of the potassium nitrate was removed from this aqueous solution after four stages. Therefore, increasing the dissolved solids content when forming the tobacco extract results in more efficient removal of nitrate with each extraction stage.

Moreover, it is preferable to create the tobacco extract as early in the curing process as possible to avoid formation of nitrosamines by reaction of nicotine and nitrate or nitrite. The present invention applies to the tobacco extract from a solid tobacco, preferably a green tobacco, but also from a cured tobacco. If cured tobacco is used for extract formation, some nitrosamines that may have formed during the curing process will migrate into the aqueous extract. The inventive extraction procedure can extract nitrosamines from the aqueous tobacco extract into the crown ether carrier solvent. Preferred carrier solvents for nitrosamine extraction are methylene chloride and chloroform.

The solvent phase is formed by mixing an organic solvent (the "carrier solvent") with a crown ether. The organic solvent is aqueous immiscible. The organic solvent can be a single solvent or a mixture of solvents having the following characteristics:

1. High solvation of $NO_3^-$, such that $\Delta G°_{H2O}-\Delta G°_{solvent}$ is negative or slightly positive;

2. High solvation for $K^+$;

3. High solubility of CE and CE cation complex;

4. No solvent reaction with $NO_3^-$, aqueous phase or aqueous phase components;

5. No functional groups that interfere with $K^+$ stripping;

6. No functional groups which contribute to ether hydrolysis;

7. Solvent does not hydrolyze in strip solution;

8. Low solvent solubility in water. Solvent solubilities of less than 5 g/liter are preferred because such solvents can be more easily removed upon final scrubbing of the aqueous tobacco extract at the completion of the denitrification process;

9. Low viscosity, preferably between about 0.2 cps and about 25 cps to allow for phase disengagement;

10. Sufficient density difference from the aqueous phase to allow for rapid phase disengagement;

11. Low propensity to form aqueous emulsions;

12. Low water solubility in organic solvent, preferably less than about 1% $H_2O$ in solvent; and 13. Organic solvent does not form a non-strippable adduct with the CE.

Examples of solvents that satisfy the thirteen criteria described herein include, but are not limited to, chloroform, kerosene or other alkanes, substituted phenols, such as mono, di, or tri halogenated phenols wherein the halogens are selected from the group consisting of fluorine, chlorine, and bromine, chlorinated or fluorinated alkanes from $C_1$ to $C_{12}$ carbon atoms in length having straight or branched chains, long chain alcohols from 6 to 15 carbon atoms in length, nitro-substituted alkanes or aromatics such as nitromethane or nitrobenzene, alkyl nitriles such as hexylnitrile, and combinations thereof.

The crown ether (CE) is first added to the carrier organic solvent prior to addition of the solvent phase to the aqueous phase. The crown ether is generally a cyclic compound that can loosely bind to cations of appropriate dimensions with its heterocyclic oxygens and then transport the cation into the organic phase due to the lipophilic character of the distal part of the heterocyclic ring and the ring substituents. One can engineer a crown ether to be selective for oxy-complexing metal cations of specific radii, such as potassium and rubidium (Rb). Examples of appropriate crown ethers that can "chelate" K or Rb include, for example, 18-crown-6 ether (18C6), benzo-15-crown-5, dibenzo-15-crown-6, cyclic tetramer of THF, benzo-15-crown-5-HCHO copolymer, dibenzo-18-crown-6 (DB18C6), dibenzo-18-crown-6HCHO copolymer, dicyclohexano-18-crown-6 (DC18C6), and crown ether carboxylic acids having the structure

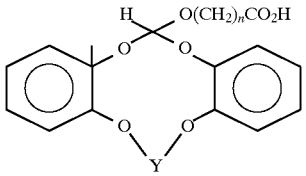

wherein when n=1, Y is $CH_2CH_2$, $CH_2CH_2CH_2$, $CH_2CH_2OCH_2CH_2$, or $CH_2CH_2OCH_2CH_2OCH_2CH_2$, and when n=2, Y is $CH_2CH_2OCH_2CH_2$, and combinations thereof. It is also possible to utilize a crown ether-like solute ("CE-like solute"), wherein a crown ether like solute comprises a straight or substituted chain ether having a reiterated vicinal ether hetero atom function, which, when freely solvated does not form a closed loop or "crown" but which, in the presence of charged species, will wrap around a cation of proper dimensions to complex or chelate the cation. Such a class of materials would be the class of podands, either having a single chain or a multiply branched chain. This will form a crown-like moiety that is strongly multidentately bonded, much like a crown ether-cation complex. An example of such straight chain ethers (often called "glymes") include:

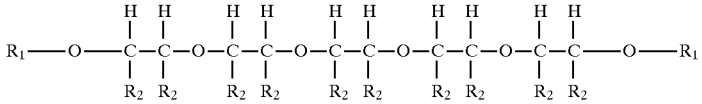

wherein $R_1$ is a sterically non-hindering group such as $—CH_3$, $—CF_3$ or $—CH_2—CH_3$, and $R_2$ is a lipophilic group such as benzo, $—(CH_2)_n—CH_3$ wherein n is an integer from about 3 to 12, or a bridging group such as

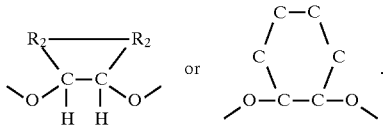

A third class of applicable CE-like solutes are multicyclic nitrogen bridgehead etheric cryptands. Monocyclic crowns are generally preferable in this application because podands would lack equivalent cationic selectivity and the cryptands would suffer from kinetic and steric impediments. Accordingly, CE-like solutes comprise cryptans, podands and glymes.

Generally, it is possible to add CE to organic solvent at a concentration of, at most, about 2.0M CE. Preferably, a 0.1M concentration of crown ether in organic solvent is appropriate for a concentration of about 3.7% (v/w). It is desirable to achieve as high a concentration of CE in organic solvent as possible to maximize nitrate extraction efficiency, while not sacrificing desirable properties of the organic phase such as low viscosity and beneficial solvation interactions between the carrier organic solvent and target anions and cations in the aqueous tobacco extract. Optimal concentration ranges of CE to organic solvent are from about 0.05M to about 1.0M CE.

The aqueous tobacco extract of cured or green tobacco material or suspension of tobacco solids in aqueous solution is mixed with organic solvent containing CE. The aqueous extract is usually buffered to about pH 6.0 to about 7.0 (preferably about 6.3) due to the presence of significant concentrations of organic acids extracted from solid tobacco material, such as fumaric, malic, oxalic and citric acids. The ratio of CE+solvent to aqueous tobacco material is from 1:1 to 4:1 (v/v). Preferably, the ratio is about 2 parts CE+solvent to 1 part aqueous tobacco extract.

During each stage of extraction, CE plus solvent and aqueous tobacco material are mixed and agitated at an energy below that which forms an emulsion. The mixing and agitating is preferably performed within the range of 5°–30° C. to retain tobacco quality but inhibit microorganism growth, such as bacteria or molds. Equilibrium is usually achieved in at most 15 minutes under these reaction conditions. Fluorinated surfactants such as various commercially formulated fluorinated materials such as FC-100 or FC-740 (3M Corp.) which modify surface tension or fluorinated carrier solvents such as 1, 1, 2-trichlorotrifluoroethane may be necessary to inhibit emulsion formation. During this process, crown ether in the solvent contacts the metal cation (preferably K and lesser amounts of Rb and Sr) in the aqueous tobacco material and forms a positively-charged crown ether-metal chelation. This positively charged material couples with an anion (nitrate or nitrite) to form a crown ether-cation-anion complex ("complex") which is substantially soluble in the organic solvent. This process of coupling nitrate (inorganic anion) to a positively-charged metal cation-crown ether complex is called counterion coextraction. In the inventive tobacco process procedure, nitrate and nitrite are the preferred anions over organic anions maleate, oxalate, citrate or fumarate because these organic anions have lower solubility in the organic solvent and because a crown ether-cation-organic anion complex is much less soluble in the organic solvent than a crown ether-cation-inorganic anion complex. Moreover, nitrate and nitrite are the preferred anions in the crown ether-cation-inorganic anion complex transport into the organic phase, rather than chloride and sulfate, anions which are also abundant in tobacco material.

The efficiency of extraction of each stage can be controlled by the concentration of CE in the organic solvent. The higher the concentration of CE, the greater the extraction of nitrate and nitrite anions per stage. The process is repeated in subsequent stages, with each stage extracting similar percentages of nitrate and nitrite from the tobacco material. Generally, when at least 80% of the nitrate in tobacco material is to be extracted, at least three or four stages will be needed to minimize crown ether inventory in the extraction circuit.

After the aqueous tobacco extract has undergone nitrate and nitrite extraction, the scrubbed, denitrified aqueous tobacco extract is added back to fibrous solid tobacco residue by procedures commonly used in the industry. Alternatively, the aqueous denitrated tobacco extract could be spray dried, stored and then redissolved in water when used at a later time. It is also possible to concentrate the denitrified tobacco extract prior to reapplication to fibrous tobacco material to make reconstituted tobacco. The denitrified tobacco materials or reconstituted tobacco may then be further treated by the addition of suitable casings, flavorants and the like and then dried and utilized in the production of smoking products. Smoking products formed from these reconstituted tobacco materials, denitrified in accordance with the method of this invention, deliver reduced oxides of nitrogen upon pyrolysis.

The inventive process can also extract potassium from tobacco materials. In some instances, it may be desirable to retain approximately the same concentration of potassium in denitrified tobacco extracts. In this case, (and when using tobacco extracts having about 0.8M nitrate concentrations) it is desirable to add KCl, $K_2SO_4$, $Rb_2SO_4$, $SrCl_2$, RbCl, or combinations thereof salt to the aqueous tobacco extract before the denitrification procedure. The concentration of KCl, $K_2SO_4$, $Rb_2SO_4$ or RbCl or combinations thereof should be equal to the approximate amount of nitrate that will be removed, on a molar basis. It is also possible to replace potassium ion with potassium from KCl or another appropriate salt (such as potassium maleate) after completion of the nitrate extraction procedure to restore appropriate potassium concentrations in the tobacco extract before reconstituting the fibrous solid tobacco material. Rubidium (which is a natural component of tobacco extract) is added instead of potassium before extraction because Rb can be complexed by the crown ethers with greater affinity than K. Moreover, RbCl will not "salt-out" KCl from untreated aqueous tobacco extract as additions of potassium salts would do, thereby improving transferable cation activity that can co-transport nitrate and nitrite. Further, Rb can be recycled in a capture loop in the strip cycle of a continuous processing system described herein when the loaded crown ether is unloaded and recycled back for further extraction.

After each stage of extraction, the aqueous solution (often the lighter, upper phase) is removed and added to the next stage or used to reconstitute fibrous solid tobacco material. The organic phase (often the heavier, lower phase) is recycled to remove potassium or rubidium nitrate or nitrite from the crown ether complex. It is economically advantageous to recycle crown ethers by removing nitrate salts from the crown ether complex. This is accomplished, for example, by contacting the organic carrier solvent phase either with water or a dilute (0.05 to 2.0M) aqueous strong acid (e.g., sulfuric or hydrochloric) to strip anions and cations from the crown ether. The organic carrier phase is agitated with the aqueous stripping acid (pH less than 7.0) whereby the anions and cations pass to the aqueous phase and the regenerated crown ether remains in the organic carrier solvent. The aqueous phase and organic carrier phase are separated whereby the organic carrier solvent/CE can be reused and the nitrate is removed as a byproduct.

The nitrate-containing byproduct may contain small amounts of barium, but primarily contains potassium nitrate. Barium is removed from this byproduct by dissolving the byproduct in a slightly basic solution of from about pH 7.5 to about pH 10 containing a bidentate ligand. Examples of bidentate ligands include, for example, EDTA. The bidentate ligand will chelate barium ion but leave the other cation, potassium, in solution. The bidentate ligand-barium complex is removed from this solution and the remaining solution dried to form a potassium nitrate dried material. Dilute nitrate and nitrite in the aqueous phase is used as a fertilizer (provided, however, that the pH of the stripping solution is close to 7.0). Moreover, concentrated nitrate is stripped with 0.1M to 1.0M sulfuric acid with subsequent recovery of $HNO_3$ and $K_2SO_4$ upon evaporation.

In a membrane separation process for selectively removing nitrate, nitrite, other nitrosating agents and barium ions from tobacco products, an aqueous feed stream comprising the tobacco material, preferably a tobacco extract, is presented to one side of a nonporous hydrophillic membrane that acts as a physical barrier to prevent bulk mixing of the aqueous phase and an organic phase of a second side of the membrane. The organic phase comprises an organic carrier solvent and a crown ether, as described herein. The membranes are preferably configured as hollow fibers and arranged in hollow fiber modules. In this configuration, the aqueous feed tobacco solution flows through a nodule shell on the exterior or first side of the hollow fiber membranes at relatively low pressure (e.g., 5 psi). The organic phase flows countercurrently through the interiors or second sides of the hollow fiber membranes at a pressure at about 10 psi greater than the pressure of the aqueous solution. So long as the aqueous stream follows a relatively turbulent flow path and the surface area of the hollow fiber membranes is great enough to allow for contact between phases across the membrane, barium and potassium cations will complex with the crown ether and then "drag" nitrate and nitrite anions into the organic phase. Therefore, the organic phase will effectively remove nitrate, nitrite and barium ions from the aqueous phase in a continuous flow process. In such a modular process, crown ether can be continuous regenerated and nitrate/nitrite and barium byproducts can be separated.

When using a membrane-based process for extracting nitrate, nitrite and barium from aqueous tobacco product feed streams, the aqueous tobacco extract feed stream flows on a first side of a nonporous hydrophillic membrane and the organic carrier solvent and CE flows in a countercurrent direction of the second side of the membrane. The nonporous hydrophillic membrane is permeable to small molecules (e.g., molecular weight of less than 1000 daltons) but is impermeable to larger molecules. The membrane in this process can be hydrophillic or hydrophobic, porous or nonporous. Examples of such membranes are shown in Table 1 below.

TABLE 1

| Hollow-fiber Membrane | Wall Structure (thickness) | Source |
|---|---|---|
| Hydrophilic | | |
| regenerated cellulose | nonporous (6 μm) | Enka, AG |
| polyacrylonitrile | ultraporous (30 μm) | ASHI Medical |
| polyacrylnitrile | ultraporous (unknown) | Sepracor, Inc. |
| Hydrophobic | | |
| polypropylene | microporous (25 μm) | Hoechst-Celenese |
| polypropylene | microporous (>100 μm) | Enka AG |

It should be noted that ultraporous membranes have pore sizes of the order of 0.01 μm and microporous membranes have pore sizes of the order of 0.2 μm.

Nonporous membranes are permeable only to "small" molecules (e.g., molecular weight of less than 1000 daltons) and impermeable to macromolecules. Therefore, nonporous regenerated cellulose membranes are preferred for the inventive extraction procedure when used in a membrane-based system. When regenerated cellulose membranes are used, the membrane is wetted only by water on the first side of the membrane and not by organic carrier solvent on the second side. Therefore, the membrane acts as a physical barrier that prevents bulk mixing of the aqueous solution and the organic carrier solvent.

A hydrophillic membrane is wetted only by the aqueous solution on the first side of the membrane and not by the organic carrier solvent. Therefore, the membrane acts as a physical barrier that prevents bulk mixing of the aqueous solution and the organic carrier solvent.

Transport of nitrate, nitrite and barium through the membrane is governed by thermodynamic factors and kinetic factors. Thermodynamic factors are the extent to which nitrate, nitrite and barium partition into the organic carrier solvent at equilibrium and this is characterized by a organic/aqueous distribution coefficient (D). Kinetic factors are the rate of nitrate, nitrite and barium transport through the membrane and across the aqueous/organic carrier solvent interface, and this is characterized by membrane permeability (P). The transport rate is a relationship of thermodynamic and kinetic parameters according to the following equation:

$$\text{Transport Rate}=P\times A\times(\text{Caq}-\text{Corg}/D),$$

wherein A is membrane area, Caq is the nitrate, nitrite and barium concentrations in the aqueous tobacco extract and Corg is the nitrate, nitrite and barium concentrations in the organic carrier solvent. The equation states that transport rate is proportional to permeability (a constant), membrane area and driving force (in brackets).

Membranes are generally arranged as hollow fibers and configured as hollow fiber modules. In this configuration, the aqueous tobacco extract (i.e., feed solution) flows through a module shell on the exterior of hollow fibers at low pressure (i.e., from about 2 psi to about 20 psi). The organic carrier solvent, comprising the crown ether, flow countercurrently through the interior of the fibers at a pressure from about 4 psi to about 20 psi greater than the pressure of the feed stream. This organic-to-aqueous pressure differential is required to prevent flow of water into the organic carrier solvent.

Figure 2:
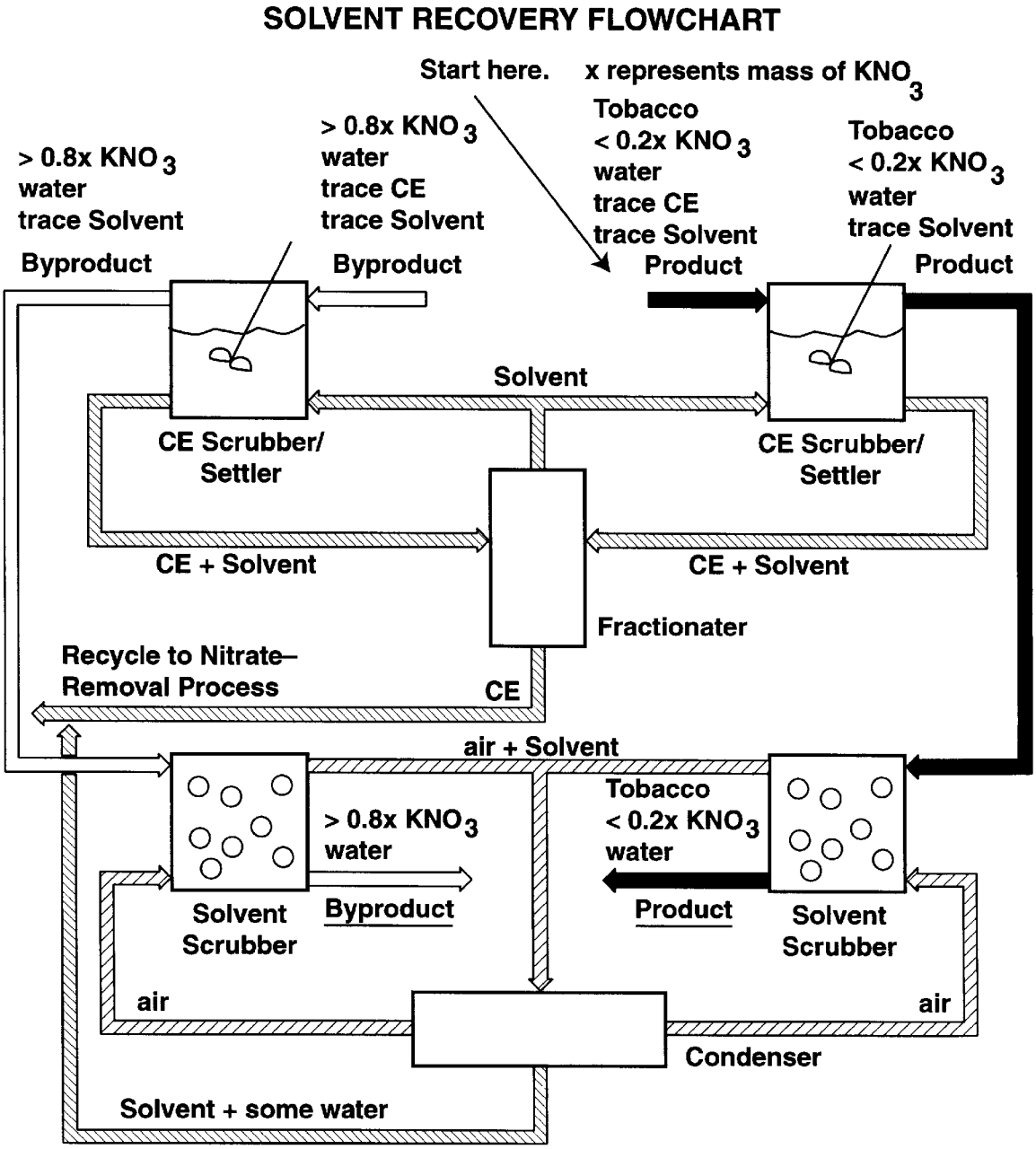
FIG. 2 illustrates a solvent and crown ether (CE) recovery flowchart.

The extraction procedure can be performed in a discontinuous batch process or as a continuous process, even when performed in several stages. For example, FIG. 1 illustrates a schematic diagram of a continuous flow extraction line having a heavy CE plus organic carrier solvent stream flowing counter to a light aqueous tobacco extract stream. FIG. 2 illustrates recycling of the CE and solvent recovery during a multiple stage process. The aqueous tobacco material passes through several stages. In each stage, the denitrified aqueous phase is sequentially contacted with stripped CE-organic carrier solvent and then the two phases are separated. It may be necessary to use low speed centrifugation to accelerate separation of the phases. The aqueous phase is carried directly to the next stage in a continuous processing system. The organic carrier phase is carried to a nitrate and nitrite stripping contactor.

The organic carrier phase containing the crown ether-cation-nitrate or nitrite complex is stripped by contact with a dilute aqueous solution of a a strong aqueous acid as described herein. The stripping process generates recycled "empty" CE plus organic carrier solvent and an aqueous nitrified strip stream. The stripped organic carrier solvent-CE phase is recycled back for use at an extracting stage. The aqueous strip stream is scrubbed with a volatile solvent (scrubbing solvent) to scavenge dissolved CE for recycling. Examples of scrubbing solvents include light (C2–C4) ethers, alkanes such as pentane or hexane, petroleum ether, fluorinated hydrocarbons such as Freon® 123 and freon substitutes, and combinations thereof. The scrubbed aqueous strip stream is discharged for use as a nitrogen containing byproduct. Recovered CE is obtained by evaporating the volatile scrubber solvent to separately recover CE and the scrubbing solvent. The CE is returned to the organic carrier solvent and the condensed volatile scrubber solvent is returned to the scrubber circuit.

Similarly, after the final extraction stage, the denitrified aqueous tobacco material is scrubbed with a toxicologically acceptable volatile scrubber solvent, as described above, to scavenge CE and CE-organic carrier solvent. Scavenged CE and organic carrier solvent are fractionated to separate the scrubber solvent and the CE and its carrier solvent. The scrubber solvent is returned to the scrubber circuit, and the CE-organic solvent recycled for further extraction stages. This leaves aqueous denitrified and scrubbed tobacco material that is used to reconstitute smoking material. This aqueous phase was previously separated (gravitationally) from the organic scrubber phase, comprising the scrubber solvent, crown ether and carrier solvent. The organic phase is fractionated to separate the high vapor pressure scrubber solvent (or its azeotrope) from the low vapor pressure mixture of crown ether and carrier solvent.

TSNA Elimination

The present invention further provides for elimination of nitrosamines from tobacco extracts or food stuffs. The $N_2O_3$ precursors are removed from liquid foodstuffs, including tobacco extracts, by co-extraction of the anionic nitrate/nitrite at appropriate pH's as described herein. After reduction of $N_2O_3$ precursors to levels at which forward nitrosation is thermodynamically unfavorable, the processed food/tobacco stream has its native N-nitrosamine content diminished by the inventive process for eliminating nitrosamines, including TSNAs. The reverse of the nitrosation reaction is also kinetically catalyzed by backside $SN_2$ attack by a nucleophilic substituent "X" such as chloride, bromide, or preferably thiocyanate, which then cleaves the leaving group "NOX." Since NOX is a powerful nitrosating agent, it is removed as effectively as possible by a trapping sink and either transported out of a system or deactivated. A trapping sink comprises select transition metal complexes which are readily nitrosated to form representative nitrosyl complexes with little kinetic or thermodynamic hindrance. Alternatively, there are other trapping scenarios, such as reaction of NOX with species such as azide or sulfamic acid that are extremely effective, however the presence of products of the reaction, or unconsumed reactants, such as hydrazine or excess azide is not appropriate for foodstuffs (e.g., toxicology problems).

Prior to or coincident with the introduction of the NOX trapping transition metal complex, the denitrosation reaction of native nitrosamines is catalyzed by the introduction, if necessary, of a nucleophile, such as $SCN^-$ as the potassium salt. The release NOX is then either trapped by the sink or destroyed by a toxicologically acceptable free radical interceptor, such as ascorbic acid or tocopherol. Preferably, the select transition metal nitrosyl sinks may include, for example, mononuclear species containing ruthenium, iridium, rhodium, cobalt, iron, molybdenum, and combinations thereof. Each transition metal is in an appropriate oxidation state with an appropriate ligand field. Thus, polyhomonuclear and polyheteronuclear complexes of the exemplified transition metals may be employed as nitrosyl sinks.

One can prevent contamination of the foodstuffs/tobacco extract by the NO binding metal complex by attachment of the transition metal complex, by $\pi$-bonding of the metal or $\sigma$-or $\pi$-bonding of an appropriate ligand to a polymer backbone. Alternatively, a solution of the transition metal nitrosyl complex in a liquid membrane will also prevent its entry into an aqueous foodstuff/tobacco extract. Pumping the transition metal trap is effected by electron or proton or other fluxes.

Denitrosation of nitrosamines is not necessarily limited to nucleophilic catalyzed NO cleavage, but may also be induced photolyticaly, thermally, or by other oxidative or reductive chemical agents. In any case, it is still necessary to trap the NO and free radical leaving fragments to prevent renitrosation of the nitrogenous substrate by any of the above-indicated procedures.

It may also be necessary to prevent catalyzed renitrosation of the denitrated foodstuff/tobacco extract by subsequent bacterial activity, by removing the nucleophilic catalyst. The nucleophilic catalyst can be removed, for example, by adding a toxicologically acceptable $K^+A^-$ salt, wherein $A^-$ is a nontransferrant anion and the KSCN is removed by a crown ether co-ionic extraction (which typically has a favorable partition coefficient), permitting effective $SCN^-$ depletion in the processed foodstuff/tobacco extract.

Alternative Supercritical Extraction and TSNA Elimination Process

The solubilization of the principal cation $K^+$ in a tobacco product of tobacco extract in supercritical $CO_2$, $N_2O$ or other neutral or nonpolar supercritical or subcritical mobile solvent phases, and the consequent ion pair charge coupling with $NO_3^-$ and $NO_2^-$ anions, is effected in subcritical or supercritical solvents, such as $CO_2$ which have low solvation for $K^+$ by addition of such solvents of polar compounds (such as $H_2O$, EtOH, or $SO_2$) or, preferably, simple or polyethers (such as glymes) or substituted simple of polyethers (e.g., fluorine substituted) or podands of branched or simple ethers or ketones, or mono or poly macrocyclic homo or hetero ethers or ketones, such as crown ethers or cryptands in such concentration that the condition of supercriticality is not disturbed if the process is carried out supercritically. $K^+$ saturated ligand and its saturated $K^+$ and charge-paired $NO_3^-$, $NO_2^-$ anion are transported to a trapping or stripping surface wherein the $K^+$ and $NO_3^-$ and $NO_2^-$ are deposited in a supercritical $CO_2$ (or an ether) insoluble phase by enhanced ionic solubility of $K^+NO_3^-$, $K+NO_2^-$ in a polar $CO_2$ insoluble phase, or a phase which exchanges, for example, protons for $K^+$ or a phase which has selective activity towards $NO_3^-$, such as a nitron solution or a nitron membrane. The aforementioned acceptor phases may be either in direct static or circulatory contact with the $CO_2$ (or ether) mobile phase, or be separated from the $CO_2$ (or ether) mobile phase by a micropermeable membrane with a static or circulating phase on the acceptor side.

When the mobile phase has been denitrified, it is further processed to eliminate nitrosamines, or allow to deposit its denitrified solutes onto the original or new batch of tobacco material by adjusting the parameters controlling its supercritical (or subcritical) state. If further processing to eliminate nitrosamines (including TSNAs) is carried out, the mobile phase (which may be a modified supercritical $CO_2$ (plus MeOH) or subcritical solvent mobile phase, or preferably a more lipophilic mobile phase (such as $N_2O$, Freon® or an alkane or an alkene of up to 12 carbon atoms) is subject to further processing as described herein. There is within the mobile phase, or contained on surfaces in contact with the mobile phase are either 2) or 1) +2). 1) is a catalyst acting to kinetically enhance $SN_2$ backside nucleophilic attack on the nitrosamine substrate by a catalytic nucleophile (such as $Br^-$, $I^-$, $SCN^-$ or combinations thereof) such that NOX is released upon substitution. 2) is a trapping sink for NOX either dissolved in the mobile phase or, preferably, contained in a separate immiscible surface in contact with the mobile phase, or carried on a solution separated from the mobile phase by a selective membrane which selectively transfers NO to a scavenger phase. The scavenger or trapping phases, in direct or membrane-mediated contact with the mobile phase are static or circulated for continuous operation. The NO-trapping scheme inhibits renitrosation of an amino substrate by the NOX released by nucleophillic substitution. The trapping species is any material which reacts with NO (NOX) to produce a toxicologically innocuous material such as $N_2$ (e.g., azide, sulfonic acid reactants), or a material which strongly adducts NO (or NOX) such as some transition metal complexes and preferably complexes of ruthenium, iridium, iron, cobalt, molybdenum, and combinations thereof in the appropriate oxidation states and with appropriate ligand fields. The transition metal complexes may be incorporated into membranes to produce membranes which selectively transport NO into a membrane-separated phase which contains NO reactants (such as azide) which would not be appropriate for food contact upon direct contact with the mobile phase, but which would be acceptable with membrane contact, or which produces NO reaction products (such as hydrazine) which would be toxicologically objectionable upon direct contact with the mobile phase.

The mobile phase of a tobacco extract that has been denitrosated is deposited on the tobacco product by adjusting physical parameters to reduce its solvency for the solute load by transforming it to a subcritical state, if previously supercritical. The desirable organoleptic flavor and addictive compounds (e.g., nicotine) of the denitrified tobacco extract are retained and returned to the tobacco smoking or chewing product in a denitrosated condition. Prior removal of $NO_3^-$ and $NO_2^-$ as described herein, will prevent renitrosation upon storage so that preformed TSNAs do not form in the treated tobacco product.

The following extractions were conducted in a batch mode and are designed to illustrate the inventive process. Utilizing the data obtained in a batch process, a skilled individual will be able to conduct the inventive process in a commercial scale continuous process, for example, in an arrangement illustrated in FIGS. 1 and 2.

EXAMPLE 1

This example illustrates removal of nitrate from an extract of Burley tobacco material in a five stage process. A 1.5% dissolved tobacco solids aqueous solution was prepared in distilled water at 10° C. Dicyclohexano-18-crown-6 ether (Aldrich Chemical, Milwaukee, Wis.) was added to chloroform to a concentration of 0.1 Molar or 3.7% CE in solvent. Chloroform plus CE (organic solvent) was added to the aqueous tobacco solution at a ratio of 2:1 organic solvent to aqueous solution. The solvent/aqueous mixture was agitated in a closed tube for 15 min. at 10° C. Agitation was stopped and the aqueous and organic phases separated. A small aliquot of aqueous material was removed for analysis. The organic phase was removed and new chloroform plus CE was added for a second stage extraction at the same ratio of organic carrier solvent to aqueous solution. The procedure was repeated for a total of five stages. Nitrate ion, chloride ion and potassium ion assays were performed from each stage.

After each stage, the solvent was collected and potassium nitrate removed from the crown ether-potassium-nitrate complex by mixing the loaded crown ether and chloroform solvent with 0.1M sulfuric acid, pH 1.0, at 10° C. for 15 min. Aqueous phase was separated from organic phase and the organic phase was reused for further extracting the tobacco material.

Figure 3:
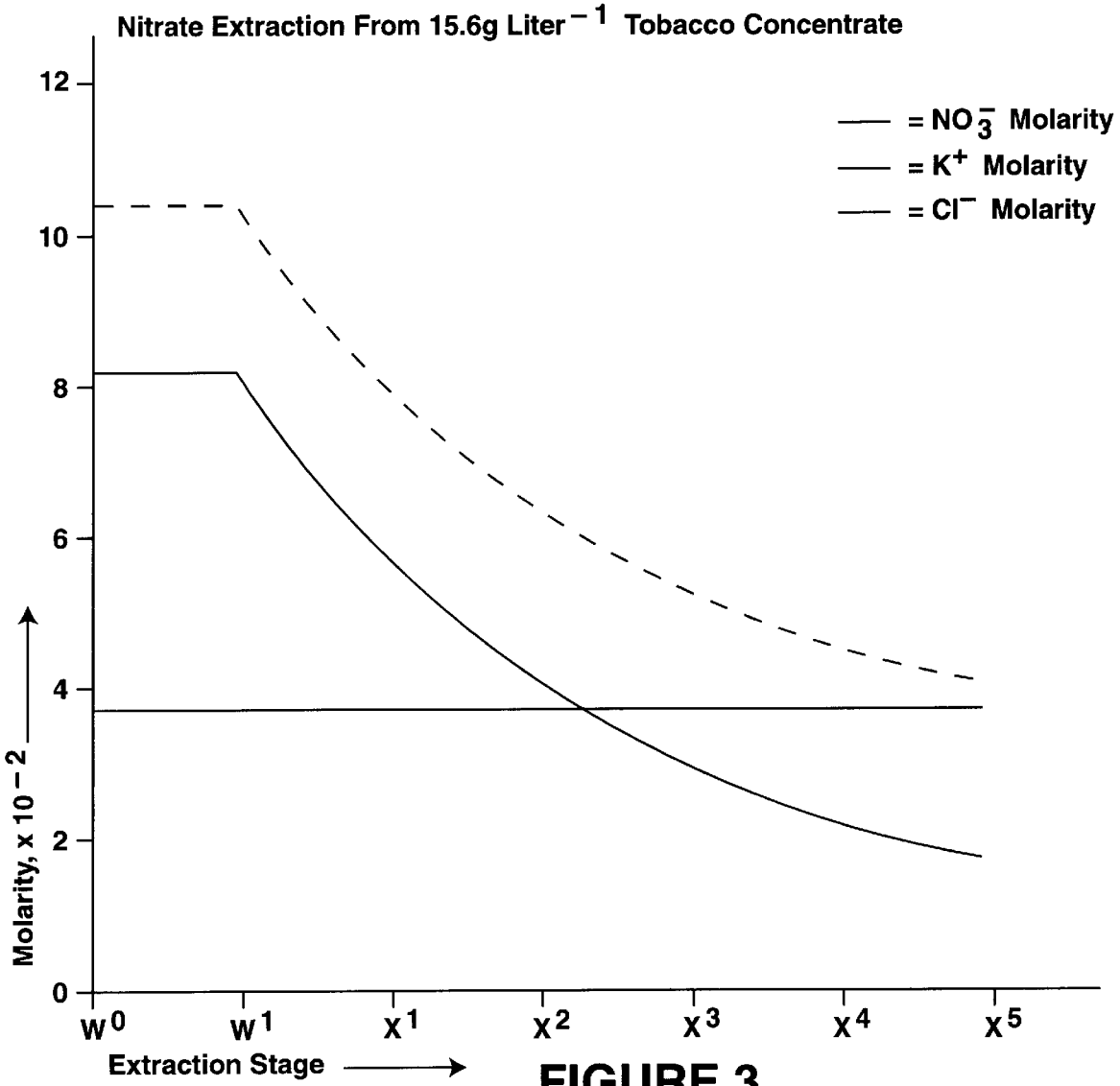
FIG. 3 illustrates that molarity of $K^+$ and $NO_3^-$ decreases after five stages of extraction described in Example 1.

The molarity of nitrate in the tobacco extract was 0.08M or 4962 ppm $NO_3^-$. After five stages, the concentration of nitrate anion decreased to 0.0145M or about 901 ppm $NO_3^-$. Similarly, the concentration of potassium cation decreased over the five stages of the extraction procedure. However, the concentration of chloride ion remained constant. These data are shown in FIG. 3.

Nitrate anion analysis was conducted by ion chromatography with conductivity detection on a Dionex® model 2000 I HPLC system. Potassium analysis was performed by optical flame atomic emission with 5000 ppm Cs ionization buffering and standard additions of potassium. Inorganic anions (including nitrate and nitrite) were analyzed by high performance liquid chromatography using a AS4-A ion exchange resin separator column, and AGI and AG4-A guard columns with a 1.8 mM $CO_3^{=}$-$HCO_3^-$ solvent system at a rate of 1.8 ml/min. Samples were measured by an in-line conductivity determination with the conductivity detector integral to the Dionex® 2000 I, where the observed chloride peak came off the column at about 1.8 min and the nitrate peak at about 3.5 min.

EXAMPLE 2

Figure 4:
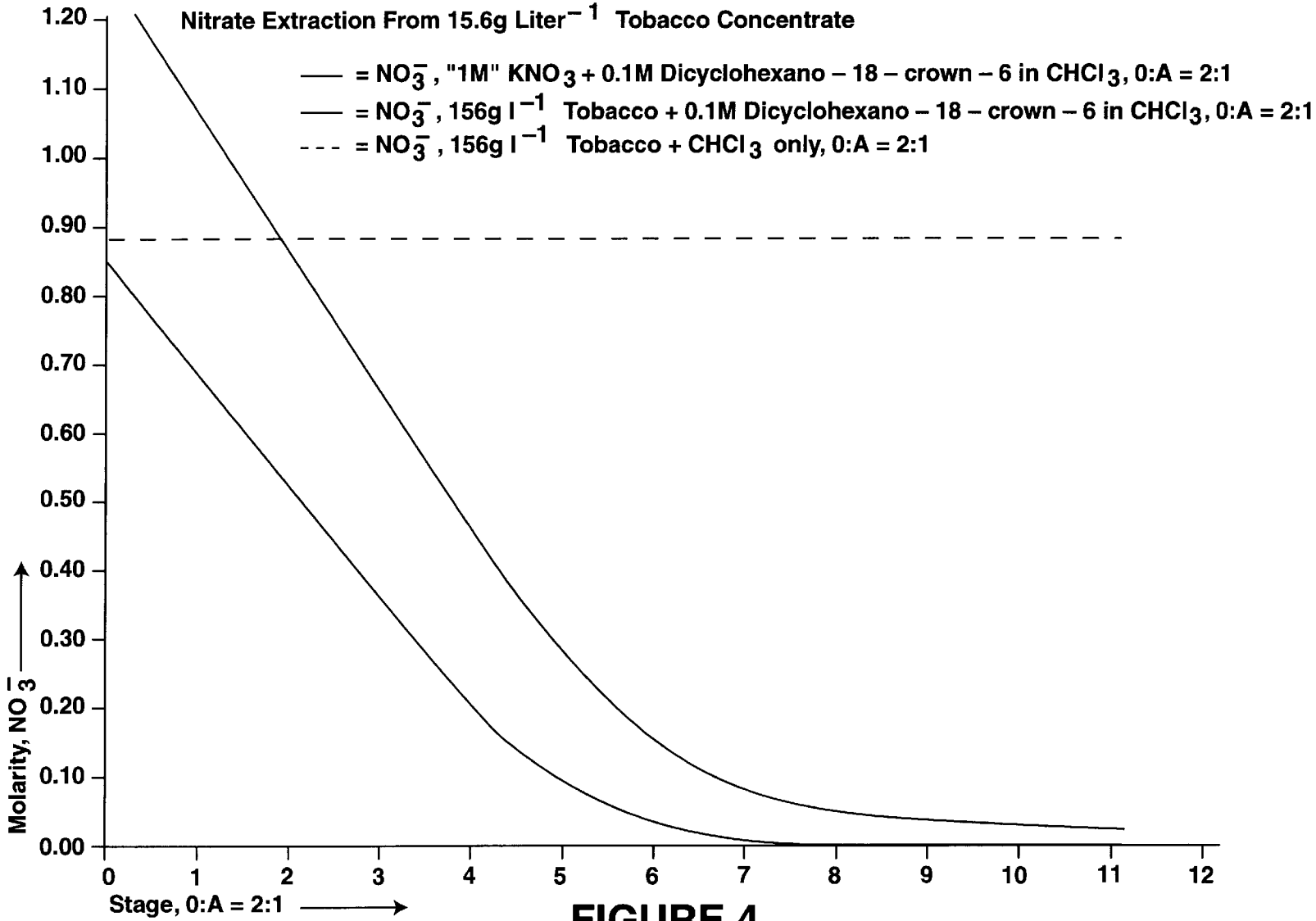
FIG. 4 illustrates the percentage change of nitrate in a tobacco extract by eleven stages of extraction with 95.95% of the original nitrate removed as described in Example 2.

This example illustrates a higher efficiency nitrate extraction process (99.95% nitrate removal) over eleven stages of extraction. However, the vast majority of nitrate was removed after the first four stages. The procedure was the same as described in Example 1 except for the following change. The tobacco extract was formed with a 15.6% dissolved tobacco solids content from Burley stem tobacco. FIG. 4 shows the percent decrease in nitrate anion in the tobacco extract after each stage of the extraction. One can control the amount of nitrate desired in a tobacco extract and in reconstituted solid tobacco material by determining the number of stages of extraction needed.

EXAMPLE 3

This example illustrates an extraction procedure utilizing a tobacco slurry made from solid tobacco material suspended in an aqueous solution instead of a soluble extract. The procedure described in Example 1 is followed except a slurry of 15% burley stem tobacco material in distilled water is made. The slurry suspends the solid tobacco material in water at 65° C. and agitates for five minutes while the slurry cools. The organic solvent/CE solution is added at a 2:1 ratio of organic phase to aqueous phase.

After completion of the extraction process, the denitrified slurry is dried to form solid reconstituted tobacco material.

EXAMPLE 4

This example illustrates the use of a single-stage membrane process for reduction of nitrate and nitrite in an aqueous extract of Burley stem tobacco. The conditions and components for this experiment are the same as in Example 1 herein, except that the organic carrier solvent and aqueous phases are pumped and recycled through a membrane module rather than being agitated together in a closed vessel. Specifically, 1000 ml of the chloroform+CE organic phase is circulated at 100 ml/min through the lumens (i.e., interiors) of nonporous, hydrophilic hollowfibers from a kidney dialysis module (CF 15-11, Travenol Laboratories, Deerfield, Ill.). The aqueous tobacco extract (500 ml) is circulated at 500 ml/min through the shell (fiber exteriors) of the module. Both the aqueous extract and the organic carrier solvent are pumped through the dialysis module, recycled to a feel reservoir, and recycled a second time through the dialysis module.

Nitrate concentration in the aqueous tobacco extract is monitored as a function of time using ion chromatography as described in Example 1. Over a 25 minute time period, nitrate concentration in the aqueous tobacco extract dropped from an initial value of 4962 ppm (4.96 g/L) to an equilibrium value of 3540 ppm (3.54 g/L). After extraction, the denitrified tobacco extract is dried and the carrier solvent recycled as described above.

EXAMPLE 5

This example illustrates a process for eliminating nitrosamines from denitrified tobacco material. Denitrified tobacco concentrate (made by procedures described herein) is contacted (at 5° C.) while stirring with an equal volume of chloroform, in 0.02M in KBr and in dicyclohexino-18-crown-6 (a phase transfer reagent for the KBr). The chloroform solution also contains 0.008M cis-dochloro-bis (2,2'-bipyridine)ruthenium II, which is the trapping species for the NO produced from the tobacco-specific nitrosamines (TSNAs), by nucleophilic substitution (by $Br^-$ reacting at the phase interfaces). The solution is stirred at 5° C. with sufficient speed to break the chloroform phase into about 100 $\mu$M droplets, but at insufficient energy to form an emulsion for 15 min, after which the stirring is stopped and the phases are permitted to disengage. Disengagement of the phases takes about 45 min, or disengagement can be accelerated by centrifugation.

While maintaining the 5° C. temperature to inhibit bacterial growth, the heavier chloroform phase is separated from the aqueous tobacco extract phase. The aqueous tobacco phase is washed with about one half volume of clean chloroform.

The used chloroform phases are combined and the ruthenium NO scavenger is regenerated by contacting the chloroform phase (with continued stirring) with an aqueous solution of 0.6M sulfuric acid in 1M HCl. Alternatively, 0.2M $NaN_3$ could be used as the aqueous reagent. Stirring is continued at about 30° C. for at least 10 min. The phases are allowed to separate by discontinuing stirring and possible by centrifugation. The regenerated chloroform-Ru phase is evaporated back to 0.08 cis-dichloro-bis (2.2'-bypyridine) ruthenium II (although the actual species recovered after recycling is Br substituted to a considerable extent, but this does not affect its effectiveness as an NO scavenger), and the $Br^-$ content is adjusted to 0.02M by adding additional KBr. If KBr does not dissolve in the chloroform phase after multiple recycling cycles, additional dicyclohexano-18-crown-6 is added to bring its concentration up to about 0.05M in chloroform.

EXAMPLE 6

This example illustrates the use of a single-stage membrane process for eliminating nitrosamines from a denitrasated aqueous extract of tobacco. The conditions and components for this experiment are the same as in Example 5 herein, except that the organic carrier solvent and aqueous phases are pumped and recycled through a membrane module, such as the one illustrated in FIG. 5, rather than being agitated together in a closed vessel. Polyethylenimine polymer is prepared by deposition on a 0.65 $\mu$m microporous PVDF membrane (Millipore), crosslinked with gluteraldehyde and then treated by immersion in an 0.1M aqueous $RuCl_3$ solution for 2 hr at 20° C. to form a metallated microporous membrane. The metallated microporous membrane was installed on a disc between pipe flanges, vertically separating a stirred chloroform solution 0.05M in dicyclohexano-18-crown-6 and 0.02M $KN_3$ at the bottom and 100 g liter$^{-1}$ denitrated tobacco extract at the top, which is also stirred. There is about a 1:1 ratio (by volume) in both chambers and a temperature maintained at about 5° C. by immersion in a thermostated cold bath. Gentle stirring is continued for at least 1 hr. The denitrosated aqueous tobacco extract is then removed and replaced with fresh aqueous extract and the cycle is repeated.

The process for removing nitrosamines from an aqueous tobacco extract can be repeated with any other aqueous material where it is desirable to remove nitrosamines. Other food materials that would be appropriated for this process include, for example, beer, whiskey and soya sauce.

We claim:

1. A process for removing barium cation and nitrate and nitrite anions from tobacco materials comprising:

(a) mixing an aqueous-immiscible organic solvent containing a crown ether having a selectivity for potassium, and an aqueous solution comprising tobacco materials or a tobacco extract;

(b) agitating the organic solvent/aqueous mixture to form a crown ether-cation-nitrate (or nitrite) complex; and (c) separating the organic phase containing the crown ether-cation-nitrate (or nitrite) complex from the aqueous phase containing the denitrified tobacco materials or denitrified tobacco extract.

2. The process of claim 1 further comprising repeating the mixing, agitating and separating steps from one to twelve additional times.

3. The process of claim 1 further comprising the step of regenerating crown ether from the crown ether-cation-nitrate complex by a process comprising:

(a) mixing the organic phase obtained from the separating step with water or a dilute solution of a strong aqueous acid having a pH below 7.0;

(b) agitating the organic solvent/aqueous acid mixture to strip the cation and anion from the crown ether-cation-nitrate complex; and (c) separating the organic phase for reuse in the extraction process from the aqueous phase containing a nitrate salt.

4. The process of claim 3 wherein the strong aqueous acid is sulfuric acid or hydrochloric acid.

5. The process of claim 3 wherein the ratio of aqueous acid to organic phase is about 1:1 on a volume basis.

6. The process of claim 1 wherein the crown ether is selected from the group consisting of dicyclohexano-18-crown-6 ether (DC18C6), 18-crown-6 ether (18C6), benzo-15-crown-5, dibenzo-15-crown-6, cyclic tetramer of THF, benzo-15-crown-5-HCHO copolymer, dibenzo-18-crown-6 (DB18C6), dibenzo-18-crown-6HCHO copolymer dicyclohexano-18-crown-6, podands, crown ether carboxylic acids having the structure

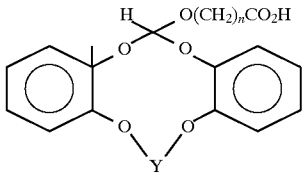

wherein when n=1, Y is $CH_2CH_2$, $CH_2CH_2CH_2$, $CH_2CH_2OCH_2CH_2$, or $CH_2CH_2OCH_2CH_2OCH_2CH_2$, and when n=2, Y is $CH_2CH_2OCH_2CH_2$, and combinations thereof.

7. The process of claim 1 wherein the ratio of the aqueous-immiscible organic solvent containing a crown ether to aqueous solution is from about 1:2 to about 4:1 on a volume basis.

8. The process of claim 1 wherein the solvent is selected from the group consisting of chloroform, kerosene, mono, di, or tri halogenated phenols wherein the halogens are selected from the group consisting of fluorine, chlorine, and bromine, chlorinated or fluorinated alkanes from $C_1$ to $C_{12}$ carbon atoms in length having straight or branched chains, long chain alcohols from 6 to 15 carbon atoms in length, nitro-substituted alkanes or aromatics, alkyl nitrites, and combinations thereof.

9. The process of claim 1 wherein the aqueous solution containing aqueous soluble components from tobacco materials is an extract of Burley stem tobacco.

10. The process of claim 9 wherein the tobacco extract is made with tobacco solids at a concentration from about 1% to about 30% in distilled water.

11. The process of claim 1 wherein the aqueous solution containing aqueous soluble components from tobacco materials is derived from green or uncured tobacco materials.

12. The process of claim 1, further comprising eliminating tobacco-specific nitrosamines (TSNAs) from the denitrified tobacco material by contacting the denitrified tobacco material with a trapping sink, wherein the trapping sink comprises a select transition metal complex which is readily nitrosated to form a nitrosyl complex with little kinetic or thermodynamic hindrance.

13. A process for selectively removing nitrate and nitrite from an aqueous solution comprising:

(a) mixing an aqueous-immiscible organic solvent containing a crown ether having a selectivity for potassium or rubidium and an aqueous solution containing nitrate or nitrite anion;

(b) agitating the organic solvent/aqueous mixture to form a crown ether-cation-nitrate (or nitrite) complex; and (c) separating the organic phase containing the crown ether-cation-nitrate (or nitrite) complex from the aqueous phase containing the denitrified aqueous solution.

14. The process of claim 13 further comprising repeating the mixing, agitating and separating steps from one to twelve additional times.

15. The process of claim 13 further comprising the step of regenerating crown ether from the crown ether-cation-nitrate complex by a process comprising:

(a) mixing the organic phase obtained from the separating step with water or a dilute solution of a strong aqueous acid having a pH below 7.0;

(b) agitating the organic solvent/aqueous acid mixture to strip the cation and anion from the crown ether-cation-nitrate complex; and (c) separating the organic phase for reuse in the extraction process from the aqueous phase containing a nitrate or nitrite salt.

16. The process of claim 15 wherein the strong inorganic acid is sulfuric acid or hydrochloric acid.

17. The process of claim 15 wherein the ratio of aqueous acid to organic phase is about 1:1 on a volume basis.

18. The process of claim 13 wherein the crown ether is selected from the group consisting of dicyclohexano-18-crown-6 ether (DC18C6), 18-crown-6 ether (18C6), benzo-15-crown-5, dibenzo-15-crown-6, cyclic tetramer of THF, benzo-15-crown-5-HCHO copolymer, dibenzo-18-crown-6 (DB18C6), dibenzo-18-crown-6HCHO copolymer, dicyclohexano-18-crown-6, podands, crown ether carboxylic acids having the structure

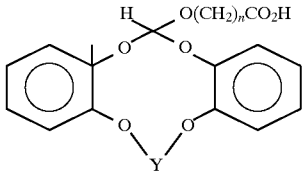

wherein when n=1, Y is $CH_2CH_2$, $CH_2CH_2CH_2$, $CH_2CH_2OCH_2CH_2$, or $CH_2CH_2OCH_2CH_2OCH_2CH_2$, and when n=2, Y is $CH_2CH_2OCH_2CH_2$, crown ether-like solutes, CE-like solutes, and combinations thereof.

19. The process of claim 13 wherein the ratio of the aqueous-immiscible organic solvent containing a crown ether to aqueous solution is from about 1:2 to about 4:1 on a volume basis.

20. The process of claim 13 wherein the solvent is selected from the group consisting of chloroform, kerosene, mono, di, or tri halogenated phenols wherein the halogens are selected from the group consisting of fluorine, chlorine, and bromine, chlorinated or fluorinated alkanes from $C_1$ to $C_{12}$ carbon atoms in length having straight or branched chains, long chain alcohols from 6 to 15 carbon atoms in length, nitro-substituted alkanes or aromatics, alkyl nitrites, and combinations thereof.

21. The process of claim 13, further comprising eliminating tobacco-specific nitrosamines (TSNAs) from the denitrified tobacco material by contacting the denitrified tobacco material with a trapping sink, wherein the trapping sink comprises a select transition metal complex which is readily nitrosated to form a nitrosyl complex with little kinetic or thermodynamic hindrance.

* * * * *